US006095243A

United States Patent [19]

Van Bilderbeek et al.

[11] Patent Number: 6,095,243

[45] Date of Patent: Aug. 1, 2000

[54] WASHOUT ARRANGEMENT FOR A WELL

[75] Inventors: Bernard Herman Van Bilderbeek, London; Mark Boyd, Norwich, both of United Kingdom

[73] Assignee: Plexus Ocean Systems Limited, Norwich, United Kingdom

[21] Appl. No.: 09/096,084

[22] Filed: Jun. 11, 1998

[30] Foreign Application Priority Data

Jun. 17, 1997 [GB] United Kingdom ..... 9712468

[51] Int. Cl.[7] ..... E21B 23/00

[52] U.S. Cl. ..... 166/208; 166/88.1

[58] Field of Search ..... 166/75.14, 87.1, 166/88.1, 97.1, 208, 242.1, 334.4, 285; 411/423, 411

[56] References Cited

U.S. PATENT DOCUMENTS 3,590,922 7/1971 Slack et al. ..... 166/208
3,885,625 5/1975 Ahlstone ..... 166/181 X
3,989,284 11/1976 Blose ..... 285/334 X
4,979,566 12/1990 Hosie et al. ..... 166/285
5,285,853 2/1994 Eckert et al. ..... 166/382

FOREIGN PATENT DOCUMENTS

520107 A1 12/1992 European Pat. Off. ..... 166/208

*Primary Examiner*—David Bagnell
*Assistant Examiner*—Jeffrey A Cader
*Attorney, Agent, or Firm*—McEachran, Jambor, Keating, Bock & Kurtz

[57] ABSTRACT

A washout arrangement for a well where a washout process is to take place to wash cement out of an annulus between two concentric casings 10, 16. Washports 36 are provided in a casing hanger 18, and an axially movable, telescopically extending lower body 40 is provided in a running tool 26 which is to engage with the casing hanger. When the running tool and casing hanger are engaged with each other, the lower body 40 can be moved axially (for example by mounting the lower body on a thread within the running tool and then rotating the lower body) between a position where it closes the washports and a position where the ports are open.

8 Claims, 1 Drawing Sheet

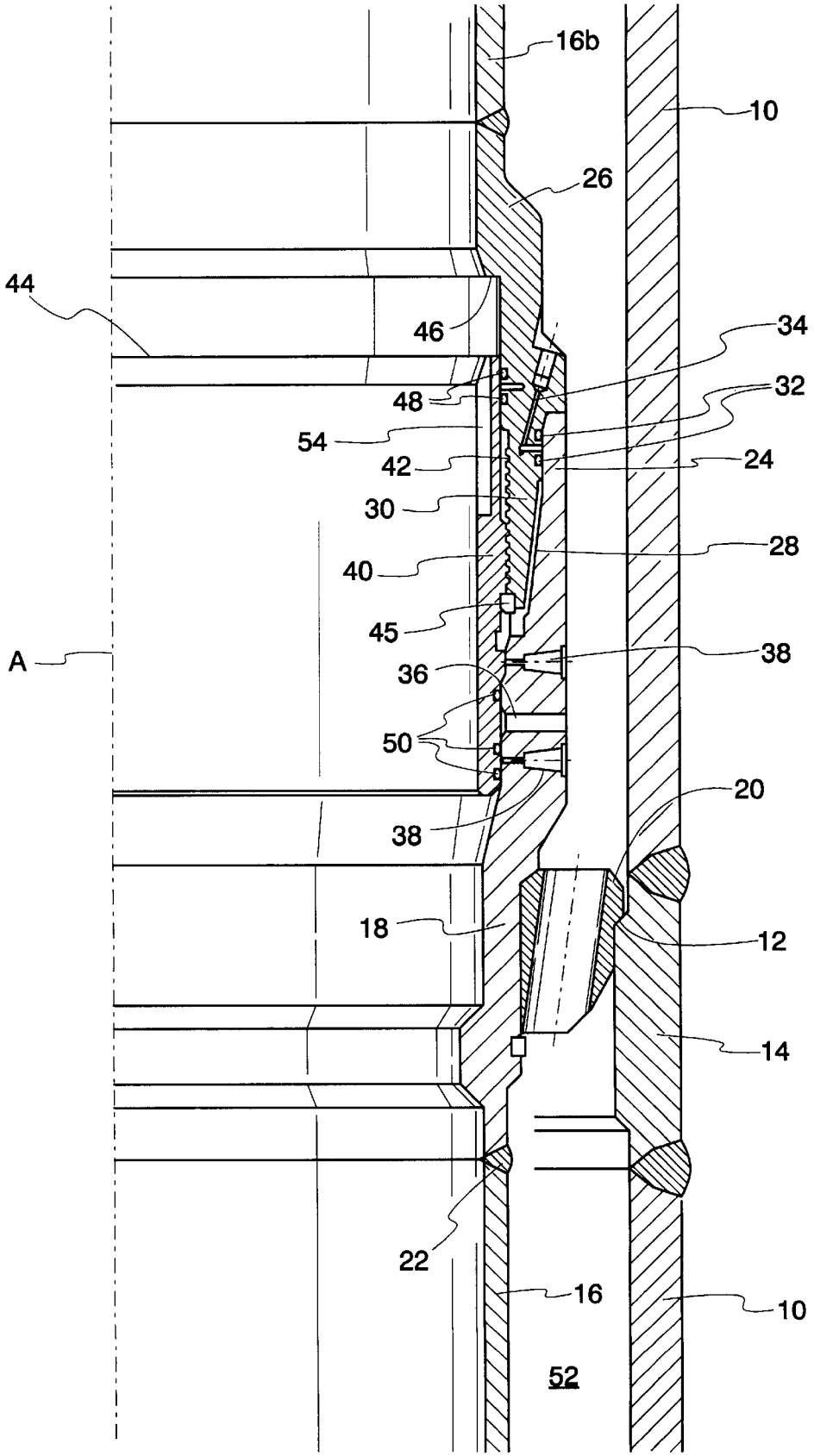
16b
10
26
44
46
34
48
32
54
42
24
30
28
40
45
A
38
36
50
20
38
18
12
14
22
16
10
52

WASHOUT ARRANGEMENT FOR A WELL

BACKGROUND OF THE INVENTION

1. Field of the Invention

This invention relates to a washout arrangement for a well, in particular for washing out the annulus surrounding a casing hanger when installing a well casing at the mudline with a jackup drilling rig.

2. Description of the Prior Art

In such installations, it is typical to use large diameter, say 30 inch (760 mm) diameter conductor which will extend from the drilling rig to a selected depth in the well. The operator will drill the well to a greater depth and install a surface casing within the conductor.

A casing hanger will then be secured to the upper end of the surface casing and this casing hanger will land on a shoulder in the conductor, approximately at the mudline. A running tool is secured to the top of the casing hanger and is used to lower the casing hanger and casing string down the well. In order to secure the surface casing string in the drilled well, cement is pumped down the casing string to return up the annulus between the casing and the drilled walls of the well and, at upper end, between the surface casing and the conductor.

After cementing, the operator will need to wash out the casing in the annulus area surrounding the casing hanger. One system which is often used makes use of washports in the casing hanger, these ports being covered up by the overlap of the running tool with the casing hanger, when the running tool is engaged with the hanger. To open the washports, the running tool is partly disengaged from the casing hanger, and water or other fluid is then pumped down the well to flow out through the washports, to flush out cement from the annulus surrounding the washports, and to clear the annulus above the washports of cement.

It is known from EP 0 272 080 to locate the washports in the running tool and to have an internal lower body within the running tool which can move up and down to open and close the ports. The operator runs a torque tool from the drilling rig down to the running tool. The torque tool engages a slot on the internal lower body and the operator rotates the torque tool. As the lower body is secured by threads to the running tool, the rotation causes the lower body to move axially upward or downward, depending on the direction of rotation of the torque tool.

SUMMARY OF THE INVENTION

According to the present invention, there is provided a washout arrangement for washing out an annulus between two casings in a well, the arrangement comprising an outer casing, an inner casing supported within the outer casing by a casing hanger body, and a running tool for running the casing hanger body in the well, the running tool and the casing hanger having engagement means by which the tool and the hanger body can be interengaged for running the hanger body in the well, wherein the casing hanger body has at least one washport extending through the wall thereof, and the running tool has a lower body mounted internally in the running tool and movable (when the running tool is engaged with the hanger body) between a first position where it does not obscure the washport(s) which are therefore open, and a second position where it does obscure the washport(s) which are therefore closed.

In this arrangement, the washports will be positioned below the interface between the running tool and the hanger body, ie at a lower position in the drill string than was the case with the prior art.

The engagement means for interengagement of the running tool and the hanger body is preferably a conventional threaded joint.

The lower body is preferably mounted in the running tool on a thread, and is adapted to be rotated (by a torque tool passed down the casing string) to produce the axial movement of the body between its first and second positions.

The thread by which the body is mounted in the running tool is preferably a square section thread.

The lower body is preferably sealed to the interior of the running tool by O-rings which are preferably located in grooves in the running tool internal wall.

The running tool preferably carries a stop to prevent the lower body from being rotated to a position where it would disengage from the running tool.

The casing hanger body may also have one or more pressure test ports extending through the body, and these port(s) can be axially spaced from the washport, in a direction further away from the interface between running tool and hanger body than the washport(s). When the running tool and casing hanger assembly is ready for installation as part of a casing string, and with the lower body in its extended position where it covers the test port(s), pressure can be applied to the test ports to verify that the seals are functioning.

The washports preferably extend radially through the hanger body, substantially at right angles to the longitudinal axis of the string.

BRIEF DESCRIPTION OF THE DRAWING

The invention will now be further described, by way of example, with reference to the accompanying drawing which shows a cross-section through one side of part of a drill string. The drill string will be symmetrical about the centre line A.

DETAILED DESCRIPTION OF THE PREFERRED EMBODIMENT

The string has an outer casing 10 (the conductor casing). Along its length this outer casing 10 has an internal shoulder 12 which is formed as a ring 14 welded between two lengths of the outer casing 10.

Within the outer casing 10, an inner casing 16 (the surface casing) is inserted, and the lower part of the surface casing 16 carries a casing hanger body 18 with an annular ring 20 which lands on the shoulder 12. The hanger body 18 is welded at 22 to the surface casing 16, which therefore "hangs" from the shoulder 12.

Above the ring 20, the hanger body 18 has a region 24 where it will engage with a hanger running tool 26. This running tool is welded to the bottom end of a further section of surface casing 16*b*.

The upper region of the hanger body 18 has a thread 28 which is formed in a conventional manner, for engagement with a corresponding thread on the lower end 30 of the running tool 26.

The running tool 26 carries two O-ring seals 32 which form a pressure tight seal with the upper part of the engagement region 24 of the hanger body. A pressure test port 34 is provided in this region, in a conventional manner, and pressure can be applied to the port 34 to check that the seals 32 are functioning.

The hanger body 18 also has a number of washports 36 which extend right through the body. Although only one washport 36 can be seen in the drawing, it will be understood that there will be a number of washports arranged equally around the circumference of the hanger body 18. Pressure test ports 38, with a diameter substantially less than that of the washports 36, also extend through the wall of the hanger body 18. Pressure can be applied to these ports to check that the seals 50, 32 and 48 are functioning.

Located internally within the running tool 26 is an axially movable lower body 40. This lower body 40, which is in the form of a sleeve or collar, has an external thread which mates with an internal thread 42 in the running tool 26. By rotating the lower body 40 relative to the running tool, the lower body can be caused to move in a telescopic manner within the running tool, between the position shown in the FIGURE where it is fully extended and a fully retracted position where the top edge 44 of the lower body comes into contact with an internal shoulder 46 in the running tool. In the fully extended position shown in the FIGURE, the lower body is retained by a stop ring 45.

In all positions, the lower body is sealed to the internal bore of the running tool by a pair of O-rings 48.

In the lowermost position which is shown in the FIGURE, the lowermost end of the lower body 40 covers both the washports 36 and the pressure test port 38, and O-rings 50 provide the necessary seal between the internal wall of the hanger body 18 and the lower body, so that the necessary seal is provided between the interior of the casing 16 and an annulus 52 between the casings 10 and 16.

The lower body 40 can however be raised in the running tool 26 by lowering a torque tool down the bore of the casing 16, to engage with one or more torque receiving features 54 of the lower body 40. If a washout operation is to be performed, the lower body can be raised by rotating the torque tool to uncover the port(s) 36.

In operation, when the surface casing 16 has been lowered into position by the running tool 26, a cementing operation is to take place to fill with cement the space in the drilled hole which surrounds the casing 16, particularly where the surface casing 16 extends down into the hole below the conductor 10. Since this space is to be completely filled to give proper support to the surface casing 16, cement is conventionally pumped out through the bottom of the surface casing 16 into the annular space, so that the fluid cement flows upwards through the annulus and also fills the annular space 52 where the surface casing 16 and conductor 10 overlap.

In mudline operations, sufficient cement will be pumped to rise at least above the washport 36, and to submerge the interface 28 between the running tool and the hanger body. In order to ensure complete filling with cement, it is the practice to overfill and then to wash out the excess, at the end of the cementing operation and before the cement has set.

When washout is to take place, the lower body 40 is raised to expose the washport, and then the interior of the surface casing 16 is pressurised with a washout liquid (usually water) which flows radially out through the ports 36 and flushes out the cement from the level of the ports upwards, so that the cementing is completed only up to the level of the washports. The annulus 52 above the washports 36 is thus cleared of cement.

It will be seen from the arrangement in the drawing that the location of the washport 36 is below the interface 28 between the hanger body and the running tool. This is advantageous, because it means that the washout/flushing operation takes place from well below the joint which ensures that the region surrounding the running tool/hanger body interface is fully washed out. If any sediment is left behind, it can collect in the annulus below this interface, so that it will not interfere with subsequent recovery of the running tool.

The lowermost end of the telescopically extendable lower body 40 can be longer or shorter than that shown, to accommodate a desired position of the washports.

The arrangement described here is substantially easier to manufacture than the previously known systems. Also, because the washport is located relatively low down in the casing string, there is no need to angle the washports downwards, as was the case with the prior art, to ensure the correct volume of washed out region.

What is claimed is:

1. A washout arrangement for washing out an annulus between two casings in a well, the arrangement comprising an outer casing, an inner casing supported within the outer casing by a casing hanger body, and a running tool for running the casing hanger body in the well, the running tool and the casing hanger having engagement means by which the tool and the hanger body can be interengaged for running the hanger body in the well, wherein the casing hanger body has at least one washport extending through the wall thereof, and the running tool has a lower body mounted internally in the running tool and movable when the running tool is engaged with the hanger body between a first position where it does not obscure the washport(s) which are therefore open, and a second position where it does obscure the washport(s) which are therefore closed.

2. A washout arrangement as claimed in claim 1, wherein the engagement means for interengagement of the running tool and the hanger body is a conventional threaded joint.

3. A washout arrangement as claimed in claim 1, wherein the lower body is mounted in the running tool on a thread, and is adapted to be rotated to produce the axial movement of the lower body between its first and second positions.

4. A washout arrangement as claimed in claim 3, wherein the thread by which the lower body is mounted in the running tool is a square section thread.

5. A washout arrangement as claimed in claim 1, wherein the lower body is sealed to the interior of the running tool by O-rings.

6. A washout arrangement as claimed in claim 5, wherein the O-rings are located in grooves in the running tool internal wall.

7. A washout arrangement as claimed in claim 1, wherein the running tool carries a stop to prevent the lower body from being rotated to a position where it would disengage from the running tool.

8. A washout arrangement as claimed in claim 1, wherein the washports extend radially through the hanger body, substantially at right angles to the longitudinal axis of the string.

* * * * *